US010772476B2

(12) United States Patent
Hunt et al.

(10) Patent No.: US 10,772,476 B2
(45) Date of Patent: Sep. 15, 2020

(54) MULTIPLE ROLL TOILET PAPER DISPENSER

(71) Applicants: Karen Isabel Hunt, Belle River (CA); Robert Wesley Hunt, Belle River (CA); Ryan Wesley Hunt, Belle River (CA)

(72) Inventors: Karen Isabel Hunt, Belle River (CA); Robert Wesley Hunt, Belle River (CA); Ryan Wesley Hunt, Belle River (CA)

( * ) Notice: Subject to any disclaimer, the term of this patent is extended or adjusted under 35 U.S.C. 154(b) by 77 days.

(21) Appl. No.: 16/239,990

(22) Filed: Jan. 4, 2019

(65) Prior Publication Data

US 2019/0200817 A1 Jul. 4, 2019

Related U.S. Application Data

(60) Provisional application No. 62/613,743, filed on Jan. 4, 2018.

(51) Int. Cl.

| | |
|---|---|
| ***A47K 10/32*** | (2006.01) |
| ***A47K 10/40*** | (2006.01) |
| ***A47K 10/22*** | (2006.01) |

(52) U.S. Cl.

CPC ..... *A47K 10/40* (2013.01); *A47K 10/22* (2013.01); *A47K 2010/3233* (2013.01); *A47K 2010/3253* (2013.01)

(58) Field of Classification Search

CPC ..... A47K 10/32; A47K 10/40; A47K 10/22; A47K 2010/3233; A47K 2010/3253

See application file for complete search history.

(56) References Cited

U.S. PATENT DOCUMENTS

| | | | | | |
|---|---|---|---|---|---|
| 2,942,795 | A * | 6/1960 | McCreary | A47K 10/38 | 242/596.4 |
| 3,374,042 | A * | 3/1968 | Smith | A47K 10/38 | 312/34.22 |
| 4,098,469 | A * | 7/1978 | McCarthy | A47K 10/38 | 242/560.3 |
| 4,294,389 | A * | 10/1981 | Falk | A47K 10/3827 | 225/34 |
| 4,314,679 | A * | 2/1982 | Paul | A47K 10/3827 | 242/560.3 |
| 4,375,874 | A * | 3/1983 | Leotta | A47K 10/38 | 242/560 |
| 4,410,221 | A * | 10/1983 | Vallis | A47K 10/3827 | 242/560.3 |
| 6,161,794 | A * | 12/2000 | Cravatt | A47K 10/38 | 242/560 |
| 6,302,350 | B1 * | 10/2001 | Burrell | A47K 10/38 | 242/560 |
| D508,354 | S * | 8/2005 | D'Agostino | D6/520 | |
| 9,408,504 | B1 * | 8/2016 | Cordeau | A47K 10/22 | |
| 2017/0251890 | A1 * | 9/2017 | Groover | A47K 10/22 | |
| 2018/0353017 | A1 * | 12/2018 | Miranda | A47K 10/22 | |

* cited by examiner

*Primary Examiner* — Christopher R Harmon
(74) *Attorney, Agent, or Firm* — Bruce A. Lev

(57) ABSTRACT

A multiple toilet paper roll holder and dispenser holding a plurality of toilet paper rolls. The invention may be inserted into and secured within a hole cut into a wall. A sliding front window may provide access to restock the device. To restock the device a user may slide a front sliding window to access the interior, and then use two roll holder guides and a toilet roll bump to stock more toilet paper rolls into the interior of the device.

12 Claims, 5 Drawing Sheets

MULTIPLE ROLL TOILET PAPER DISPENSER

CROSS-REFERENCE TO RELATED APPLICATION

The present application is related to and claims priority from prior provisional application Ser. No. 62/613,743, filed Jan. 4, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of toilet paper dispenser devices and more specifically relates to a multiple toilet paper dispenser and holder providing easy storage and accessibility for a user.

2. Description of the Related Art

Toilet paper is a sanitary tissue paper product commonly used by males and females after using a restroom. Toilet paper is produced from one-ply to six-ply, having a single sheet or multiple sheets placed back-to-back which is useful for making it stronger and more absorbent. Toilet paper rolls are often stored in various places throughout a person's bathroom, leaving a guest to search for a new roll when in need. As such, an improved means to store and dispense multiple toilet paper rolls in a convenient manner is needed.

Various attempts have been made to solve problems found in toilet paper dispenser device art. Among these are found in: U.S. Pat. No. 7,588,209 to Claude Demers; U.S. Pub. No. 2007/0205317 to Richard Miller; and U.S. Pat. No. 7,374,128 to Hendrix et al. This prior art is representative of multiple toilet paper dispenser devices. None of the above inventions and patents, taken either singly or in combination, is seen to describe the invention as claimed.

BRIEF SUMMARY OF THE INVENTION

In view of the foregoing disadvantages inherent in the known art, the present invention provides a novel toilet paper roll dispenser. The general purpose of the present invention, which will be described subsequently in greater detail, is to provide a toilet paper roll dispenser having a compartment for back up rolls.

The dispenser may be easily reloaded by a user and may provide a readily accessible new roll of toilet paper when a previous roll has run out of toilet paper. The housing of the present invention therefore comprises a storage portion and a dispensing portion which houses a plurality of toilet paper rolls.

At least four or five toilet paper rolls resides within the storage portion and one toilet paper roll resides within the dispensing portion, however more rolls are stored. The present invention is useful for conventional sized toilet paper rolls as well as a jumbo toilet paper roll. The present invention is useful for both public and private bathrooms.

The toilet roll bump disposed on the back wall of the housing supports at least 4-5 toilet paper rolls in a vertical row. The toilet roll bump is designed with enough clearance between it and a sliding panel to allow the user to pull a spare toilet paper roll down with medium to light force when the current toilet paper roll on the roller runs out.

The present invention is designed to be inserted and mounted into a pre-cut hole in a wall with a trim panel visibly located adjacent to the exterior of the wall. Adhesive attachment strips attach to a portion of a wall in order to keep the product mounted to a wall. The hole that is cut into a wall is to be cut as a 1-inch offset from the dimensions of the trim panel as to allow the adhesive attachment strips to make full contact with the wall The features of the invention which are believed to be novel are particularly pointed out and distinctly claimed in the concluding portion of the specification. These and other features, aspects, and advantages of the present invention will become better understood with reference to the following drawings and detailed description.

The present invention holds significant improvements and serves as a multiple roll toilet paper dispenser. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a multiple roll toilet paper dispenser, constructed and operative according to the teachings of the present invention.

The various embodiments of the present invention will hereinafter be described in conjunction with the appended drawings, wherein like designations denote like elements.

DETAILED DESCRIPTION

Figure 6:
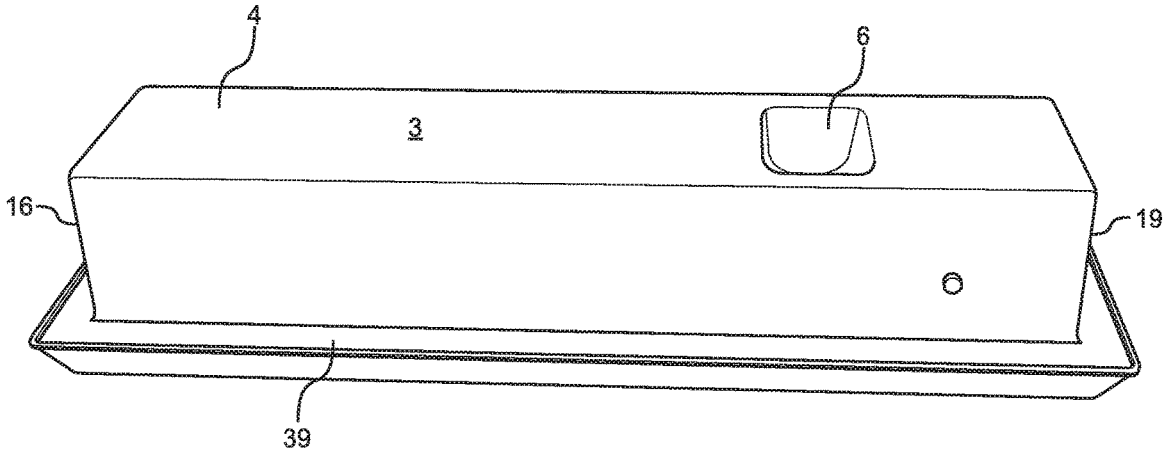
FIG. 6 is a rear and side view illustrating a multiple roll toilet paper dispenser according to an embodiment of the present invention of FIG. 1.
Figure 7:
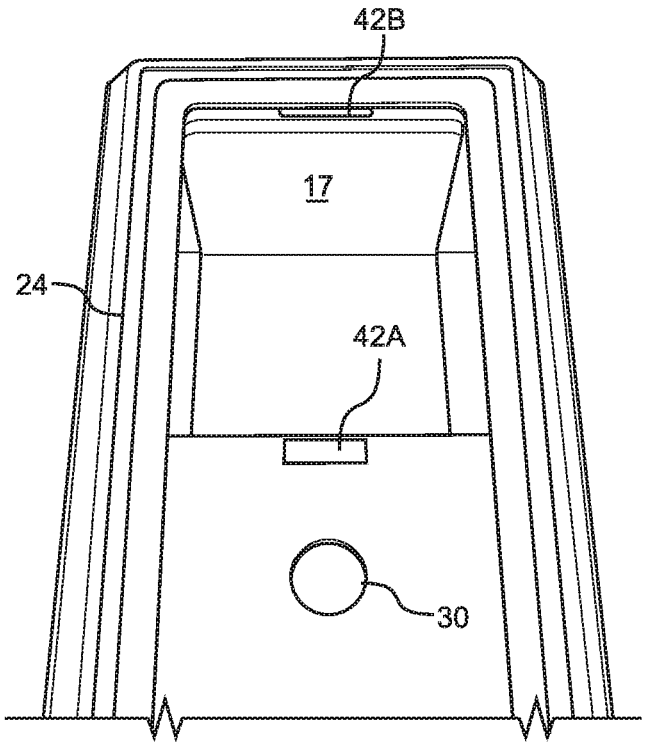
FIG. 7 is a top perspective view illustrating a multiple roll toilet paper dispenser according to an embodiment of the present invention of FIG. 1.
Figure 8:
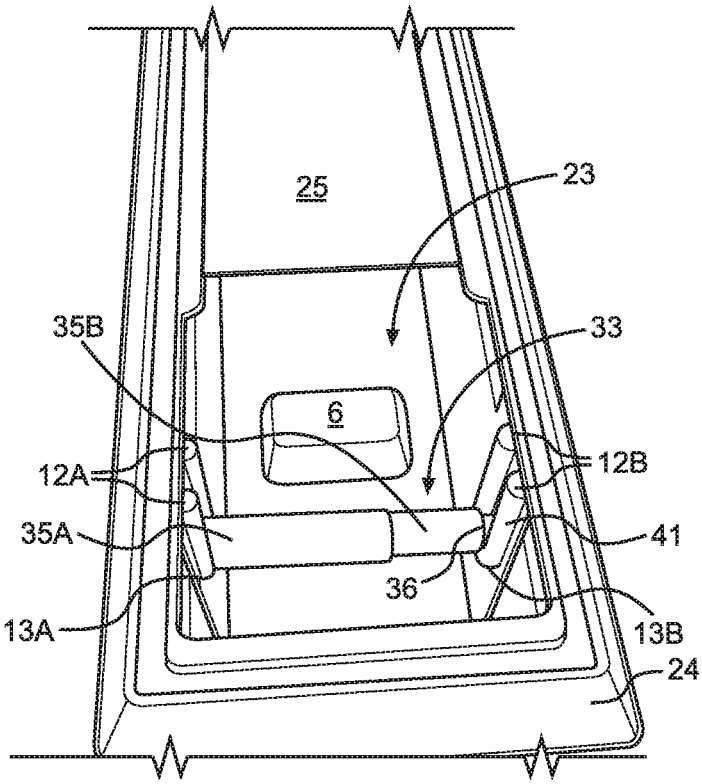
FIG. 8 is a bottom perspective view illustrating a multiple roll toilet paper dispenser according to an embodiment of the present invention of FIG. 1.
Figure 9:
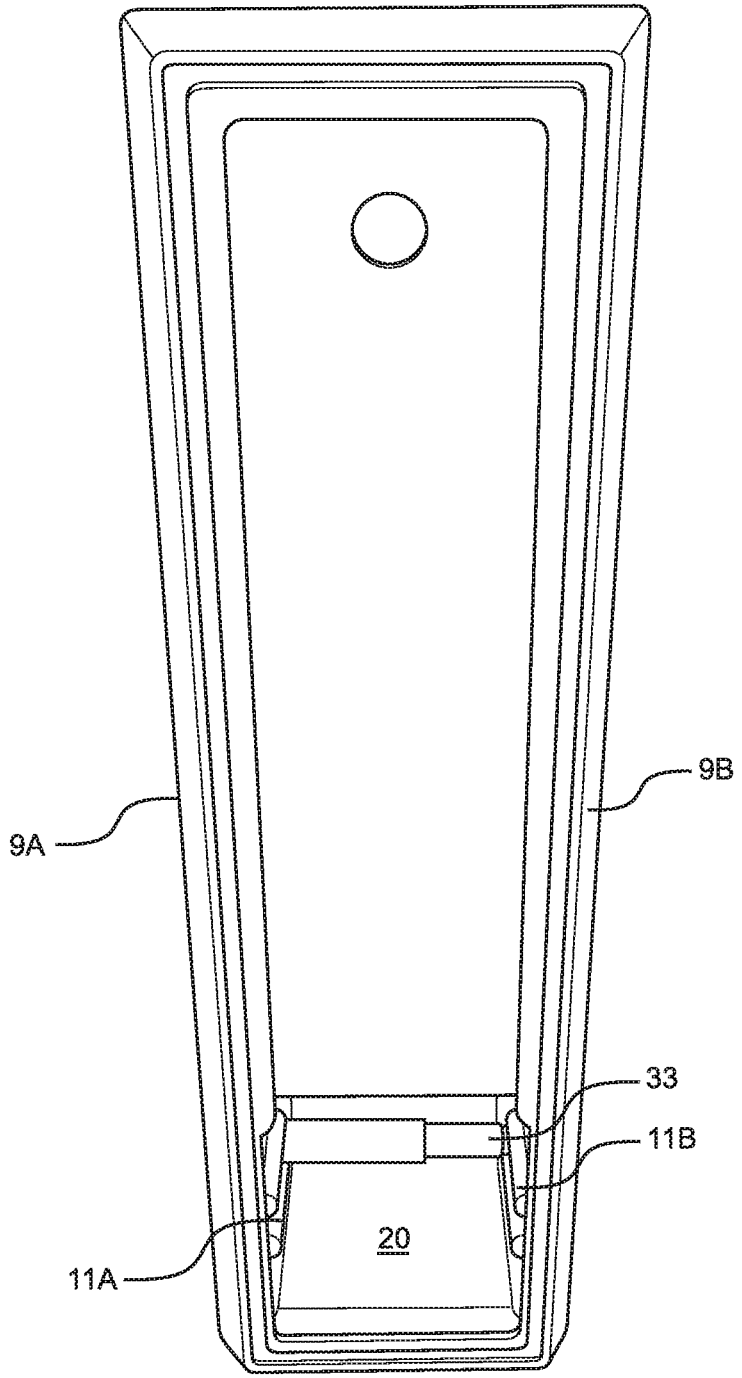
FIG. 9 is a perspective view illustrating a multiple roll toilet paper dispenser according to an embodiment of the present invention of FIG. 1.

Referring to the drawings by numerals of reference there is shown in FIGS. 1-9, a multiple roll toilet paper dispenser 1. The multiple roll toilet paper dispenser 1 comprises a housing 2 having a sliding panel 25, toilet paper roll holder 33 (as seen in FIG. 8) and adhesive attachment strips 39 (as seen in FIG. 6) for securing the multiple roll toilet paper dispenser 1 to a pre-cut hole in a wall. The housing 2 is formed from Acrylic or Plexiglass having dimensions including eight inches in width, thirty inches in height, and seven inches in depth.

The housing 2 is comprised of a back wall 3 which has an exterior surface 4, interior surface 5 and a toilet roll bump 6. The back wall 3 is substantially rectangular. The toilet roll bump 6 extends outwardly from the interior surface 5. The bump 6 serves to hold up a plurality of vertically stacked toilet paper rolls 43. The housing 2 further includes two elongated sidewalls 7A and 7B each having a length 8A and 8B respectively, exterior surface 9A and 9B respectively, elongated channels 10A and 10B (best seen in FIG. 4) respectively and roll holder guides 11A and 11B (best seen in FIG. 9) respectively.

Figure 1:
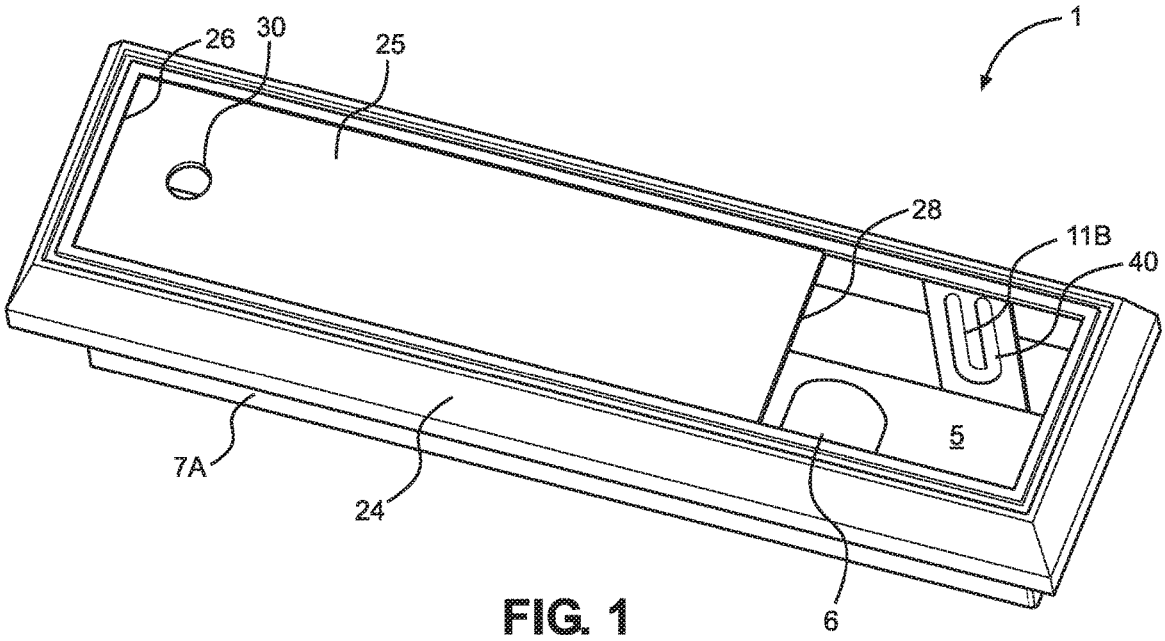
FIG. 1 shows a perspective view illustrating a multiple roll toilet paper dispenser according to an embodiment of the present invention.
Figure 2:
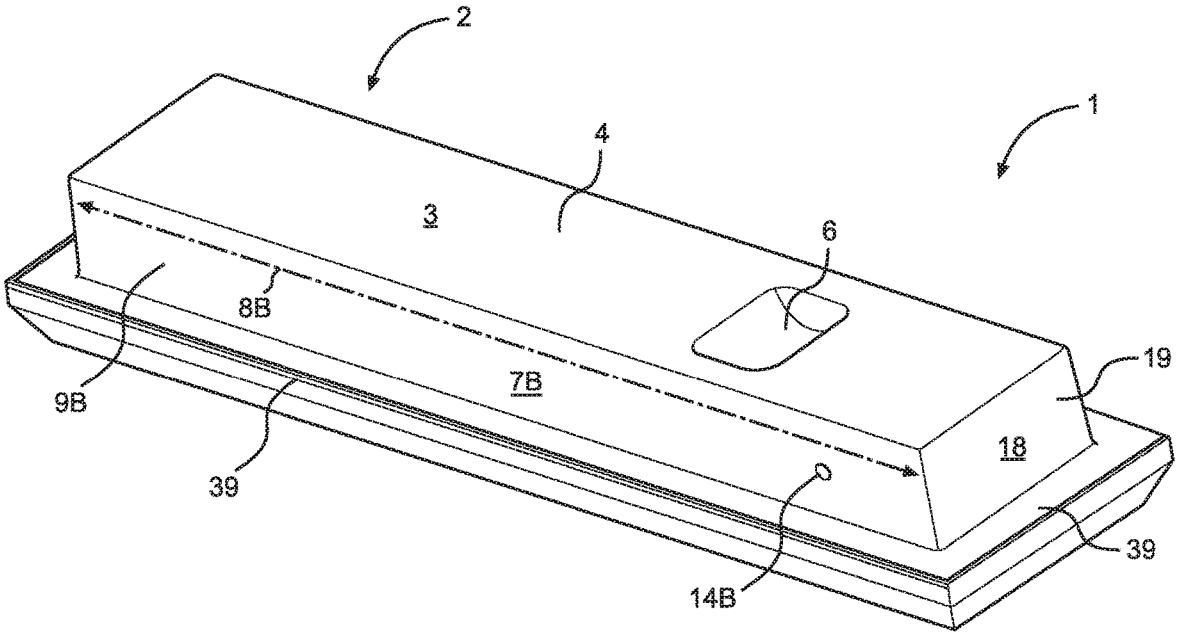
FIG. 2 is a rear view illustrating a multiple roll toilet paper dispenser according to an embodiment of the present invention of FIG. 1.
Figure 4:
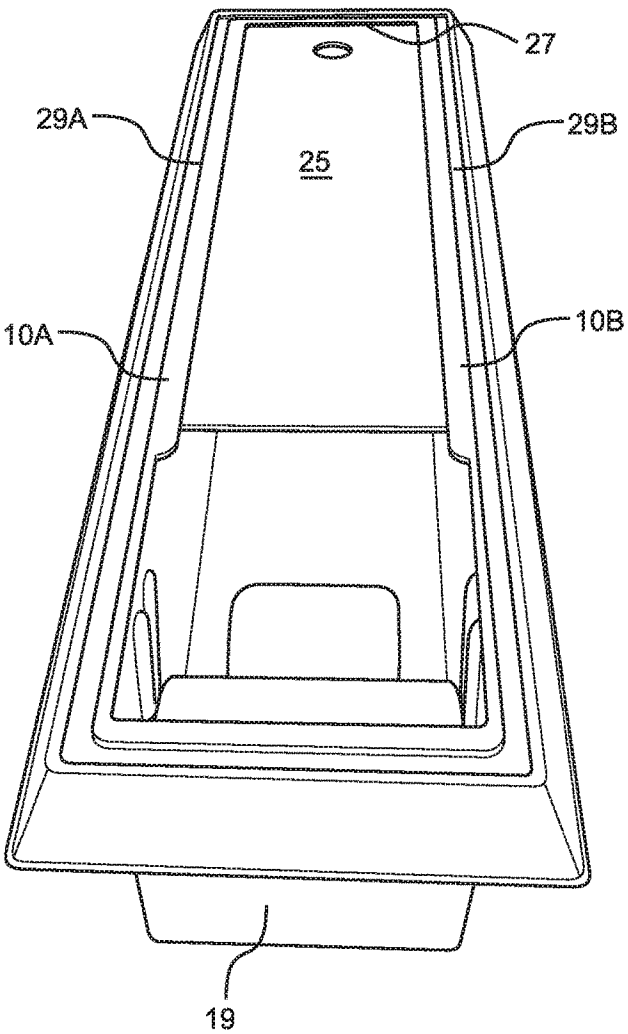
FIG. 4 is a perspective view illustrating a multiple roll toilet paper dispenser according to an embodiment of the present invention of FIG. 1.
Figure 3:
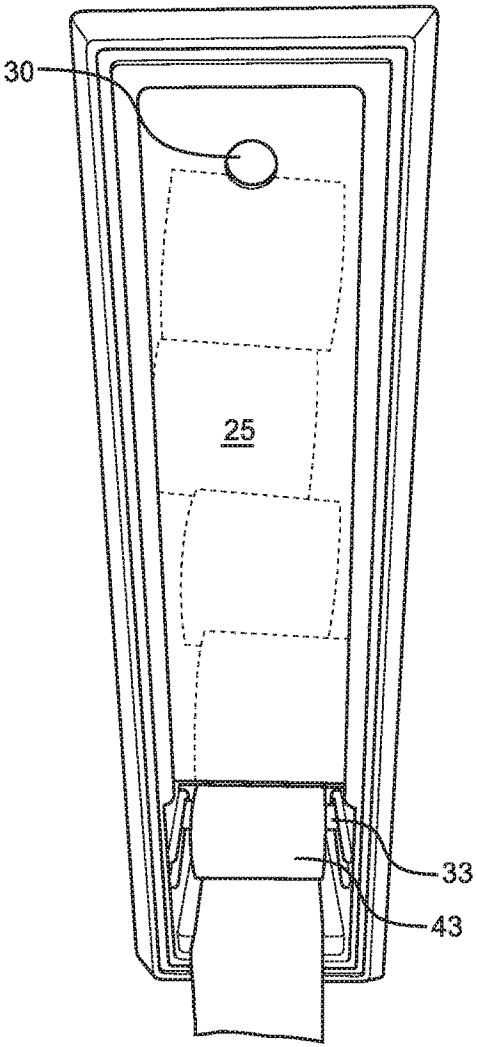
FIG. 3 is a front view illustrating a multiple roll toilet paper dispenser attached to a wall according to an embodiment of the present invention of FIG. 1.
Figure 5:
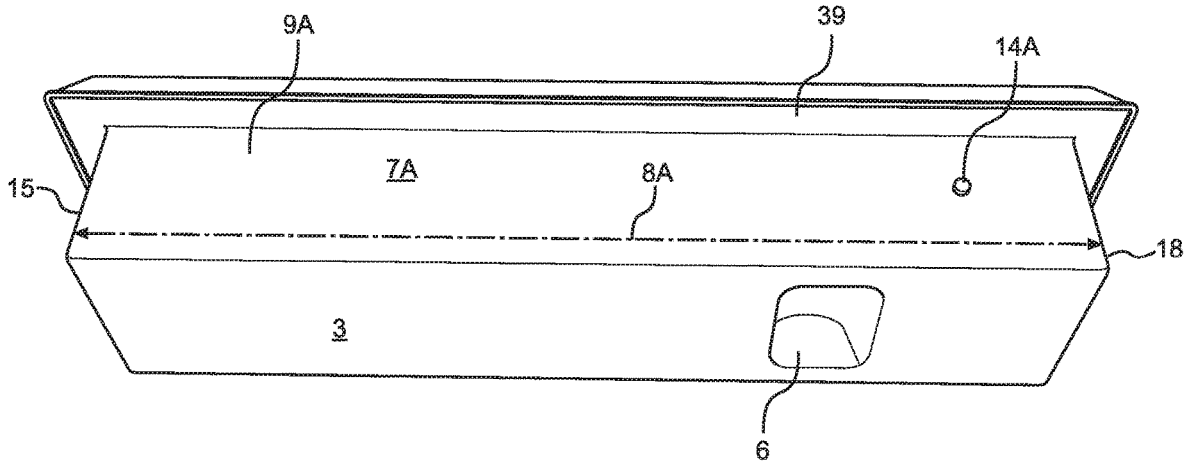
FIG. 5 is a rear and side view illustrating a multiple roll toilet paper dispenser according to an embodiment of the present invention of FIG. 1.

Each elongated sidewall 7A and 7B also has an interior surface which is parallel and opposite to each exterior surface 9A and 9B. Also, each roll holder guide 11A and 11B includes a curved ridge 40 (as best seen in FIG. 1) located upon the interior surface of each elongated sidewall 7A and 7B. The curved ridge 40 is unitarily formed with each roll holder guide 11A and 11B and is connected between respective end portions of the pair of parallel elongated ridges 12A and 12B (best seen in FIG. 8) thereby forming a U-shape.

Each elongated sidewall 7A and 7B also includes a roll holder guide 11A and 11B respectively which further includes a pair of parallel elongated ridges 12A and 12B respectively located upon the interior surface in proximity to a bottom portion 13A and 13B respectively. The parallel elongated ridges 12A and 12B extend perpendicular to the back wall 3 and are adapted to guide an end portion of a toilet paper roll holder 33 from the front edge portion toward the back wall 3 (as best seen in FIG. 8).

The toilet roll bump 6 disposed on the back wall 3 of the housing 2 supports at least 4-5 toilet paper rolls in a row. The toilet roll bump 6 is designed with enough clearance between it and a sliding panel 25 to allow the user to pull a spare toilet paper roll 43 down with medium to light force when the current toilet paper roll 43 runs out. This is easily accomplished since toilet paper rolls 43 naturally compress to some extent.

The housing 2 further includes a top wall 15 (best seen in FIG. 5) having an exterior surface 16 (best seen in FIG. 6) and an interior surface 17 wherein the top wall 15 is connected to and extends from a top edge portion of the back wall 3 and is connected between top edge portions of the two elongated sidewalls 7A and 7B.

Each elongated channel 10A and 10B is located upon and extends along a substantial length of the interior surface of each elongated sidewall 7A and 7B, extends parallel to the back wall 3 and is in proximity to a front edge portion of each elongated sidewall 7A and 7B.

The housing 2 also includes a bottom wall 18 which has an exterior surface 19 and an interior surface 20 wherein the bottom wall 18 is connected to and extends from a bottom edge portion of the back wall 3 and is connected between bottom edge portions of the two elongated sidewalls 7A and 7B.

Each elongated sidewall 7A and 7B also includes a circular depression 14A and 14B respectively located between the pair of parallel elongated ridges 12A and 12B and are adapted to releasably hold the end portion of the toilet paper roll holder 33 therein.

The two elongated sidewalls 7A and 7B are connected to and extend from opposite side edge portions of the back wall 3 wherein the lengths of 7A and 7B are substantially equal and wherein the roll holder guides 11A and 11B are located below the toilet roll bump 6 where the toilet paper roll holder 33 holds the toilet paper roll 43 that is currently in use.

The back wall 3, the two elongated sidewalls 7A and 7B, the top wall 15 and the bottom wall 18 form an interior volume having a substantially rectangular volume. The two elongated sidewalls 7A and 7B, the top wall 15, and the bottom wall 18 form a substantially rectangular front opening 23.

A trim panel 24 is attached to and extends perpendicularly from the front edge portions of the exterior surfaces 9A and 9B respectively of the two elongated sidewalls 7A and 7B, the top wall 15, and the bottom wall 18 and is adapted to be securely attached to a wall for mounting the multiple roll toilet paper dispenser 1 to the wall and into an aperture within the wall. Adhesive attachment strips 39 are located upon surfaces of the trim panel 24 and are adapted to secure the multiple roll toilet paper dispenser 1 to the wall.

The housing 2 further includes a sliding panel 25 having a top edge 26 which has a releasable attachment member 27 and a bottom edge 28. The releasable attachment member 27 is adapted to releasably attach to the top wall 15 of the housing 2 and to hold the sliding panel 25 securely against the top wall 15. The sliding panel 25 further has two spaced side edges 29A and 29B. The two spaced side edges 29A and 29B are located between the top edge 26 and bottom edge 28 and are adapted to slidably reside within respective elongated channels 10A and 10B of the housing 2. The top wall 15 further includes a magnet 42B. The releasable attachment member of the sliding panel 25 is a complementary magnet 42A which releasably engages the magnet 42B. The sliding panel is formed from a translucent material, either glass or plastic.

The sliding panel 25 further has a handle portion 30 located in proximity to the top edge 26 and is adapted to slide the sliding panel 25 within the elongated channels 10A and 10B. The handle portion 30 is formed as a circular aperture. The sliding panel 25 has a length less than the lengths of the elongated sidewalls 7A and 7B and is adapted such that when the sliding panel 25 is attached to the top wall 15, a space is formed between the bottom edge 28 of the sliding panel 25 and the bottom wall 18 of the housing 2. The space is adapted to allow a toilet paper roll holder 33 and a reduced roll of toilet paper 43 to pass outwardly from the interior volume 21 of the housing 2.

When the sliding panel 25 is slid downwardly and adjacent to the bottom wall 18, a space is formed between the top edge 26 of the sliding panel 25 and the top wall 15 adapted to allow a full roll of toilet paper 43 to pass therethrough and into the interior volume 21 of the housing 2.

The toilet paper roll holder 33 has an adjustable length and includes two telescoping tubular portions 35A and 35B which include a knob 36 on each exterior end thereof adapted to engage with a respective circular depression 14A and 14B of a respective sidewall 7A and 7B and wherein the toilet paper roll holder 33 further includes a spring member therein which is connected between the two telescoping tubular portions 35A and 35B such that its length is adjustable such that it can engage and disengage from the circular depressions 14A and 14B.

When in use, the siding panel 25 is releasably attached to the top wall of the housing wherein a first roll of toilet paper 43 can then be slid upon the toilet paper roll holder 1 and it can be attached to the circular depressions 14A and 14B. The sliding panel 25 can then be slid downwardly towards the bottom wall 18 of the housing 2 such that a plurality of toilet paper rolls 43 can be passed through the space between the top edge 26 of the sliding panel 25 and the top wall 15 of the housing 2 and stacked within the interior volume 21 above the toilet roll bump 6. Then the sliding panel 25 is slid upwards and releasably attached by the magnets 42A and 42B to the top wall 15 of the housing 2.

When an in-use roll of toilet paper 43 is reduced and it is desired to replace it with another roll of toilet paper 43, the toilet paper roll holder 33 is disconnected from the circular depressions 14A and 14B, the reduced roll of toilet paper 43 is removed and the bottom most toilet paper roll 43 above the bump 6 is removed and placed on the toilet paper roll holder 33 and reconnected with the circular depressions 14A and 14B where the fresh roll of toilet paper 43 can be accessed and used. The remaining toilet paper rolls 43 move downwardly and rest upon the bump 6.

The present invention is designed to be inserted and mounted into a pre-cut hole in a wall with the trim panel 24 visibly located adjacent to the exterior of the wall. The adhesive attachment strips 39 attach to a portion of a wall in order to keep the product mounted to a wall. The hole that is cut into a wall is to be cut as a 1-inch offset from the dimensions of the trim panel 24 as to allow the adhesive attachment strips 39 to make full contact with the wall.

Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A multiple roll toilet paper dispenser comprising:

a housing including:
- a back wall including:
  - an exterior surface;
  - an interior surface; and
  - a toilet roll bump;
    - wherein said toilet roll bump extends outwardly from said interior surface;
  - wherein said back wall is substantially rectangular;
- two elongated side walls, each including:
  - a length;
  - an exterior surface;
  - an interior surface;
  - an elongated channel;
    - wherein said elongated channel is located upon and extends along a substantial length of said interior surface, extends parallel to said back wall, and is located in proximity to a front edge portion thereof;
  - a roll holder guide including:
    - a pair of parallel elongated ridges located upon said interior surface in proximity to a bottom portion thereof, extends perpendicular to said back wall, and is adapted to guide an end portion of a toilet paper roll holder from said front edge portion toward said back wall; and
  - a circular depression;
    - wherein said circular depression is located between said pair of parallel elongated ridges and is adapted to releasably hold said end portion of said toilet paper roll holder therein;
  - wherein said two elongated side walls are connected to and extend from opposite side edge portions of said back wall;
  - wherein said lengths of said two elongated side walls are substantially equal; and
  - wherein said roll holder guides are located below said toilet roll bump;
- a top wall including:
  - an exterior surface; and
  - an interior surface;
  - wherein said top wall is connected to and extends from a top edge portion of said back wall and is connected between top edge portions of said two elongated side walls;
- a bottom wall including:
  - an exterior surface; and
  - an interior surface;
  - wherein said bottom wall is connected to and extends from a bottom edge portion of said back wall and is connected between bottom edge portions of said two elongated side walls;
- wherein said back wall, said two elongated side walls, said top wall, and said bottom wall form an interior volume having a substantially rectangular volume; and
- wherein said two elongated side walls, said top wall, and said bottom wall form an elongated and substantially rectangular front opening; and
- a trim panel;
  - wherein said trim panel is attached to and extends perpendicularly from said front edge portions of said exterior surfaces of said two elongated side walls, said top wall, and said bottom wall, and is adapted to be securely attached to a wall for mounting said multiple roll toilet paper dispenser to said wall and into an aperture within said wall;

a sliding panel including:

a top edge including:

a releasable attachment member;

wherein said releasable attachment member is adapted to releasably attach to said top wall of said housing;

a bottom edge;

two spaced side edges;

wherein said two spaced side edges are located between said top and bottom edges and are adapted to slidably reside within respective said elongated channels of said two elongated side walls of said housing;

a handle portion;

wherein said handle portion is located in proximity to said top edge and is adapted to allow a person to slide said sliding panel within said elongated channels;

wherein said sliding panel has a length less than said lengths of said two elongated side walls, and adapted such that when said sliding panel is attached to said top wall a space is formed between said bottom edge and said bottom wall of said housing adapted to allow said toilet paper roll holder and a reduced roll of toilet paper to pass outwardly from said interior volume of said housing, and wherein when said sliding panel is slid downwardly and adjacent said bottom wall a space is formed between said top edge and said top wall adapted to allow a full roll of toilet paper to pass therethrough and into said interior volume of said housing; and a toilet paper roll holder including:

an adjustable length;

two telescoping tubular portions;

wherein each of said two telescoping tubular portions includes a knob on an exterior end thereof adapted to engage with a respective said circular depression of a respective elongated side wall; and a spring member;

wherein said spring member is located within and is connected between said two telescoping tubular portions, such that its length is adjustable such that it can be engage with and disengaged from said circular depressions of said elongated side wall of said housing;

wherein when in use said sliding panel is releasably attached to said top wall of said housing, a first roll of toilet paper can then be slid upon said toilet paper roll holder, said toilet paper roll holder can then be connected with said circular depressions of said elongated side wall of said housing, then said sliding panel can be slid down towards said bottom wall such that a plurality of toilet paper rolls can pass through said space between said top edge of said sliding panel and said top wall of said housing and be stacked within said interior volume upon and above said toilet roll bump of said housing, then said sliding panel is slid upwards and releasably attached to said top wall of said housing; and wherein when said first roll of toilet paper is reduced and it is desired to replace it with another roll of toilet paper said toilet paper roll holder is disconnected from said circular depressions of said elongated side wall of said housing, said reduced roll of toilet paper is removed from said toilet paper roll holder, then the bottom most roll of said plurality of toilet paper rolls is removed from above said toilet roll bump and placed upon said toilet paper roll holder while the remaining toilet paper rolls of said plurality toilet paper rolls move downwardly upon and above said toilet roll bump, then said toilet paper roll holder is reconnected with said circular depressions of said elongated side wall of said housing such that said new roll of toilet paper can then be accessed and used.

2. The multiple roll toilet paper dispenser of claim 1, further comprising adhesive attachment strips located upon surfaces of said trim panel and adapted to secure said multiple roll toilet paper dispenser to said wall.

3. The multiple roll toilet paper dispenser of claim 1, wherein each said roll holder guide further includes a curved ridge located upon said interior surface of each respective said two elongated side walls and is connected between respective end portions of said pair of parallel elongated ridges, thereby forming a U-shape.

4. The multiple roll toilet paper dispenser of claim 1, wherein said top wall further includes a magnet attached to said front edge portion thereof; and wherein said releasable attachment member of said sliding panel is formed as a magnet adapted to releasably engage said magnet of said top wall.

5. The multiple roll toilet paper dispenser of claim 1, wherein said handle portion of said sliding panel is formed as a circular aperture therethrough adapted to allow a person to grab an edge of said circular aperture to slide said sliding panel.

6. The multiple roll toilet paper dispenser of claim 1, wherein said housing is formed from acrylic.

7. The multiple roll toilet paper dispenser of claim 1, wherein said housing is formed from plexiglass.

8. The multiple roll toilet paper dispenser of claim 1, wherein said housing is adapted to hold at least four toilet paper rolls above said toilet roll bump.

9. The multiple roll toilet paper dispenser of claim 1, wherein said housing is formed having dimensions including 8 inches in width, 30 inches in height, and 7 inches in depth.

10. The multiple roll toilet paper dispenser of claim 1, wherein said sliding panel is formed from a translucent material.

11. The multiple roll toilet paper dispenser of claim 10, wherein said translucent material is glass.

12. The multiple roll toilet paper dispenser of claim 10, wherein said translucent material is plastic.

* * * * *